US008494206B2

(12) United States Patent
Lin

(10) Patent No.: US 8,494,206 B2
(45) Date of Patent: Jul. 23, 2013

(54) ELECTRONIC DEVICE AND METHOD THEREOF

(75) Inventor: Wei-Cheng Lin, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 412 days.

(21) Appl. No.: 12/913,784

(22) Filed: Oct. 28, 2010

(65) Prior Publication Data

US 2012/0045083 A1 Feb. 23, 2012

(30) Foreign Application Priority Data

Aug. 19, 2010 (TW) ..... 99127675

(51) Int. Cl.
*H04R 25/00* (2006.01)

(52) U.S. Cl.
USPC ..... 381/380; 381/74

(58) Field of Classification Search
USPC ..... 381/380, 381, 374, 370, 384
See application file for complete search history.

(56) References Cited

U.S. PATENT DOCUMENTS

2009/0069081 A1* 3/2009 Thorner ..... 463/30
2013/0010978 A1* 1/2013 Wong et al. ..... 381/74

* cited by examiner

*Primary Examiner* — Mohammad Islam
*Assistant Examiner* — Phylesha Dabney
(74) *Attorney, Agent, or Firm* — Altis Law Group, Inc.

(57) ABSTRACT

An electronic device includes a host and an earphone. The host includes a application module, the earphone includes at least one speaker, and at least one vibrator. The host generates a first vibration signal according to an original audio signal from the application module, and sends the original audio signal and the first vibration signal to the earphone. The earphone generates a second vibration signal according to the original audio signal, sends the first vibration signal and the second vibration signal to the at least one vibrator, and sends the original audio signal to the at least one earphone speaker. The electronic device may also generate audio signals according to an original vibration signal from the application module.

13 Claims, 5 Drawing Sheets

ELECTRONIC DEVICE AND METHOD THEREOF

BACKGROUND

1. Technical Field

The present disclosure relates to electronic device and method for feeling immersement of movies or games.

2. Description of Related Art

When watching movies or playing games on an electronic device, in order to experience immersement of the movies or the games, a special motion chair is needed. Users can experience immersement of the movies or the games through the vibration or movement of the special motion chair.

Generally, the special motion chair is expensive and not inconvenient to carry. Therefore, there is room for improvement within the art.

BRIEF DESCRIPTION OF THE DRAWINGS

Many aspects of the present electronic device and method thereof can be better understood with reference to the following drawings. The components in the various drawings are not necessarily drawn to scale, the emphasis instead being placed upon clearly illustrating the principles of the present electronic device and method thereof.

DETAILED DESCRIPTION

In general, the word "module" as used herein, refers to logic embodied in hardware or firmware, or to a collection of software instructions, written in a programming language, such as, for example, Java, C, or assembly. One or more software instructions in the module may be embedded in firmware, such as an EPROM. It will be appreciated that modules may comprised connected logic units, such as gates and flip-flops, and may comprise programmable units, such as programmable gate arrays or processors. The modules described herein may be implemented as either software and/or hardware modules and may be stored in any type of computer readable medium or other computer storage system.

Figure 1:
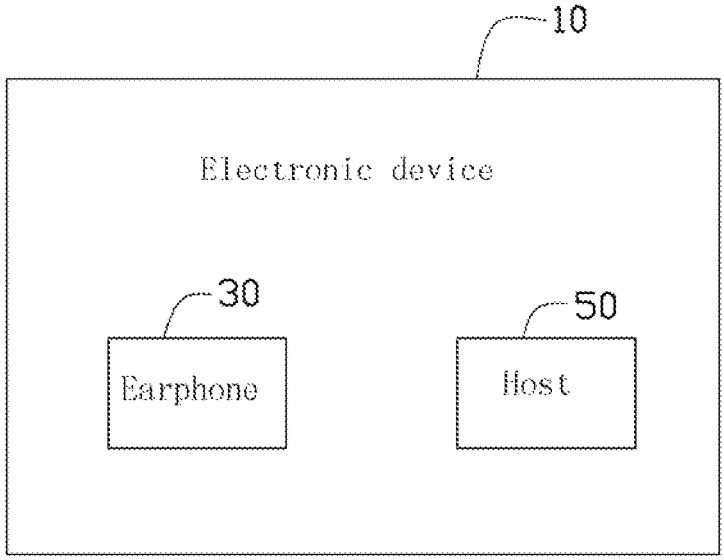
FIG. 1 is a block diagram of one embodiment of an electronic device comprising a host and an earphone.

Referring to FIG. 1, an electronic device 10 comprising a host 50 and an earphone 30 is shown. The host 50 may be mobile phone, music player, or notebook, etc. The earphone 30 communicates with the host 50 via wired or wireless connections.

Figure 2:
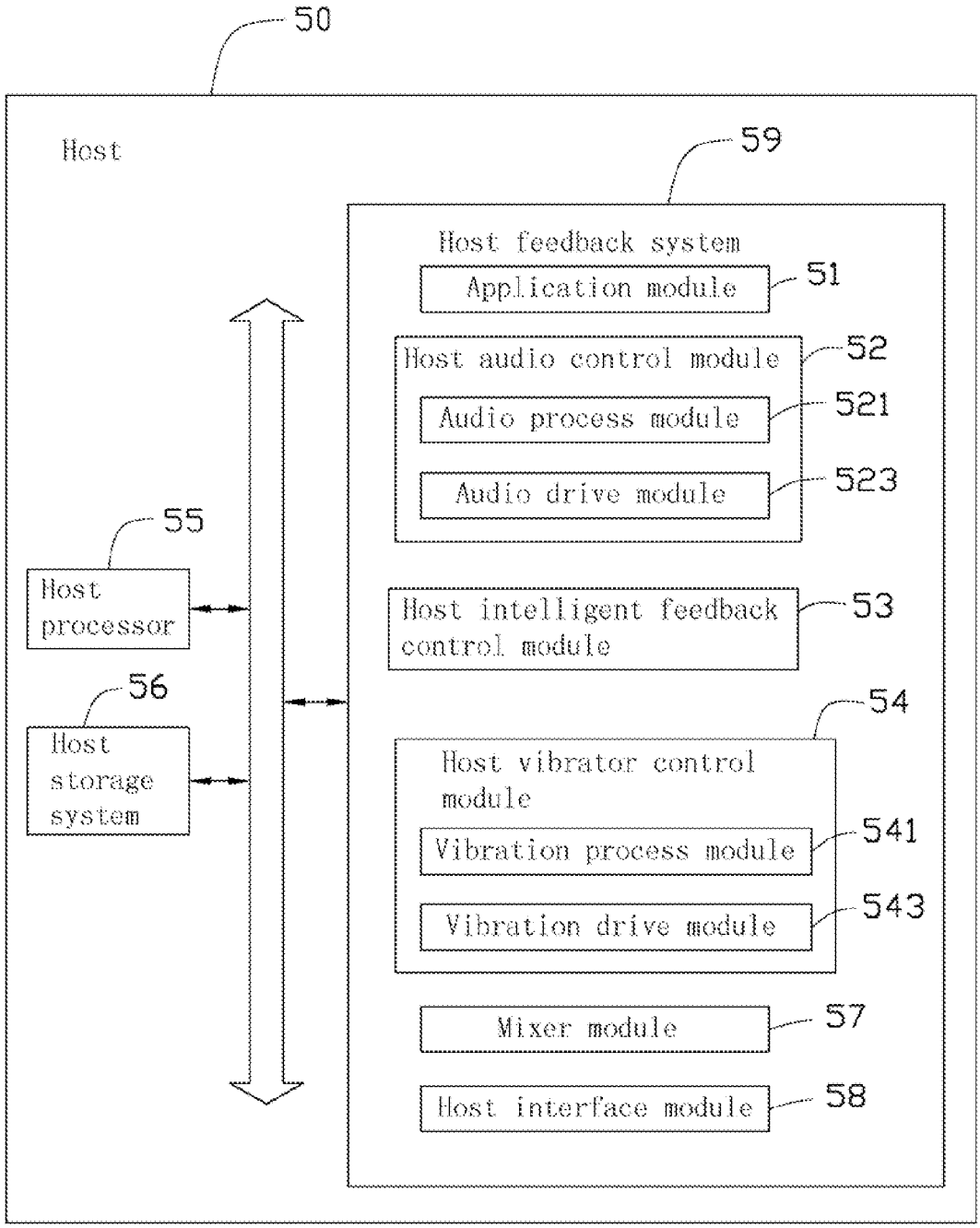
FIG. 2 is a block diagram of the host shown in FIG. 1.

Referring to FIG. 2, the host 50 includes at least one host processor 55, a host storage system 56, and a host feedback system 59. The host feedback system 59 includes an application module 51, a host audio control module 52, a host intelligent feedback control module 53, a host vibrator control module 54, a mixer module 57, and a host interface module 58. The host audio control module 52 includes an audio process module 521, and an audio drive module 523. The host vibrator control module 54 includes a vibration process module 541 and a vibration drive module 543. The above-mentioned modules of the host 50 may comprise computerized code in the form of one or more programs that are stored in the host storage system 56. The computerized code includes instructions that are executed by the at least one host processors 55 to provide functions for the modules 51, 52, 53, 57, 58 of the host 50.

The application module 51 is a built-in application of the host 50, such as a media player, a game software, for example. The application module 51 is operable to generate at least one of an original audio signal and an original vibration signal. The audio process module 521 is operable to receive the original audio signal, and send the original audio signal to the host intelligent feedback control module 53. The vibration process module 541 is operable to receive the original vibration signal, and send the original vibration signal to the host intelligent feedback control module 53. The host intelligent feedback control module 53 includes a host matching database, the host matching database includes a host audio characteristic database, a host vibration characteristic database, and a host matching table. The host audio characteristic database stores sub audio characteristics corresponding to a variety of audio signals. For example, an audio signal may include a low frequency portion, a middle frequency portion, a high frequency portion, and a cycle portion. Each portion of the audio signal may be called as a sub audio characteristic. The host vibration characteristic database stores sub vibration characteristics corresponding to a variety of vibration signals. For example, an vibration signal may include vibration amplitude parameters and vibration duration parameters corresponding to the amplitude parameters. The vibration amplitude parameter may be 0.5 millimeter, and the vibration duration parameter may be 3 seconds. One vibration amplitude parameter and the corresponding vibration duration parameter may be called as a sub vibration characteristic. The host matching table includes matching information between the sub audio characteristics and the sub vibration characteristics. The host matching database may be stored in the host storage system 56.

According to the original audio signal, the host intelligent feedback control module 53 sends a host vibration feedback signal to the vibration process module 541. The vibration process module 541 makes the vibration drive module 543 send a first vibration signal to the mixer module 57 according to the host vibration feedback signal. According to the original vibration signal, the host intelligent feedback control module 53 sends a host audio feedback signal to the audio process module 521. The audio process module 521 makes the audio drive module 523 send a first audio signal to the mixer module 57 according to the host audio feedback signal. If the application module 51 generates only an original audio signal, the first audio signal is the same as the original audio signal. If the application module 51 generates only an original vibration signal, the first vibration signal is the same as the original vibration signal.

The mixer module 57 is operable to mix the first audio signal and the first vibration signal into a mixed signal. The mixed signal is transmitted to the earphone 30 by the host interface module 58.

Figure 3:
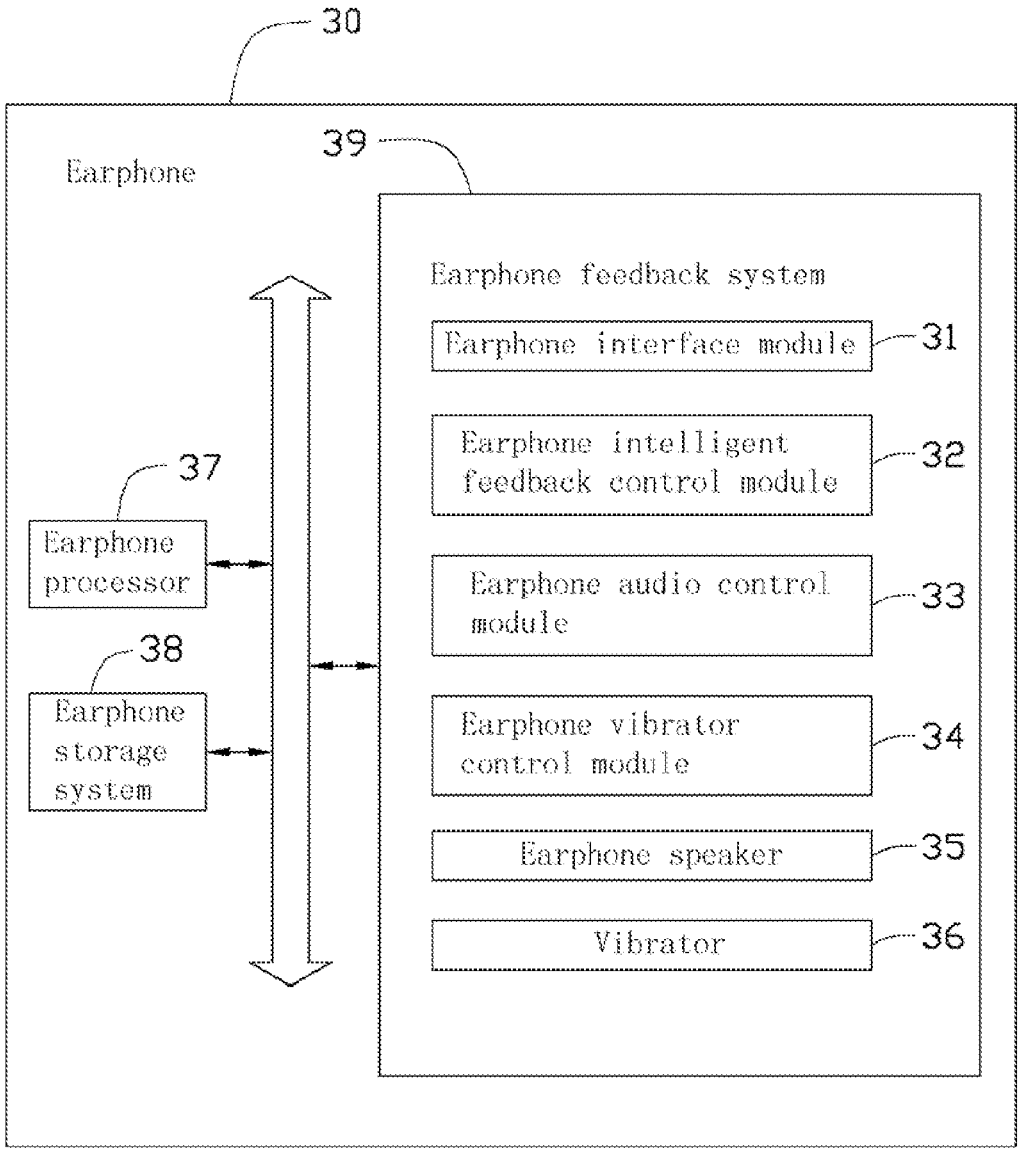
FIG. 3 is a block diagram of the earphone shown in FIG. 1.

Referring to FIG. 3, the earphone 30 includes at least one earphone processor 37, an earphone storage system 38, and an earphone feedback system 39. The earphone feedback system 39 includes an earphone interface module 31, an earphone intelligent feedback control module 32, an earphone audio control module 33, an earphone vibrator control module 34, at least one earphone speaker 35, and at least one vibrator 36. Each earphone speaker 35 corresponds to one vibrator 36. The earphone interface module 31 is matched with the host interface module 58. The above-mentioned modules of the earphone 30 may comprise computerized code in the form of one or more programs that are stored in the earphone storage system 38. The computerized code includes instructions that are executed by the at least one earphone processors 37 to provide functions for the modules 31, 32, 33, 34 of the earphone 30.

The earphone interface module 31 is operable to receive the mixed signal, and separate the mixed signal into the first audio signal and the first vibration signal. The earphone interface module 31 sends the first audio signal to the earphone audio control module 33, and sends the first vibration signal to the earphone vibrator control module 34. The earphone audio control module 33 receives the first audio signal and sends the first audio signal to the earphone intelligent feedback control module 32. The earphone vibrator control module 34 receives the first vibration signal and sends the first vibration signal to the earphone intelligent feedback control module 32. The earphone intelligent feedback control module 32 includes an earphone matching database, the earphone matching database includes an earphone audio characteristic database, an earphone vibration characteristic database, and an earphone matching table. The earphone audio characteristic database stores sub audio characteristics corresponding to a variety of audio signals. The earphone vibration characteristic database stores sub vibration characteristics corresponding to a variety of vibration signals. The earphone matching table includes matching information between the sub audio characteristics and the sub vibration characteristics. The earphone matching database may be stored in the earphone storage system 38. In the following embodiment, the matching information of the earphone matching table is included among the matching information of the host matching table.

According to the first audio signal, the earphone intelligent feedback control module 32 sends an earphone vibration feedback signal to the earphone vibrator control module 34. The earphone vibrator control module 34 generates a second vibration signal according to the earphone vibration feedback signal, and the earphone vibrator control module 34 sends the first vibration signal and the second vibration signal to the vibrator 36. The vibrator 36 vibrates according to the first vibration signal and the second vibration signal. According to the first vibration signal, the earphone intelligent feedback control module 32 sends an earphone audio feedback signal to the earphone audio control module 33. The earphone audio control module 33 generates a second audio signal according to the earphone audio feedback signal, and the earphone audio control module 33 sends the first audio signal and the second audio signal to the earphone speaker 35. The earphone speaker 35 sounds according to the first audio signal and the second audio signal. If the first audio signal is the same as the original audio signal, no second audio signal is generated. If the first vibration signal is the same as the original vibration signal, no second vibration signal is generated.

Figure 4A:
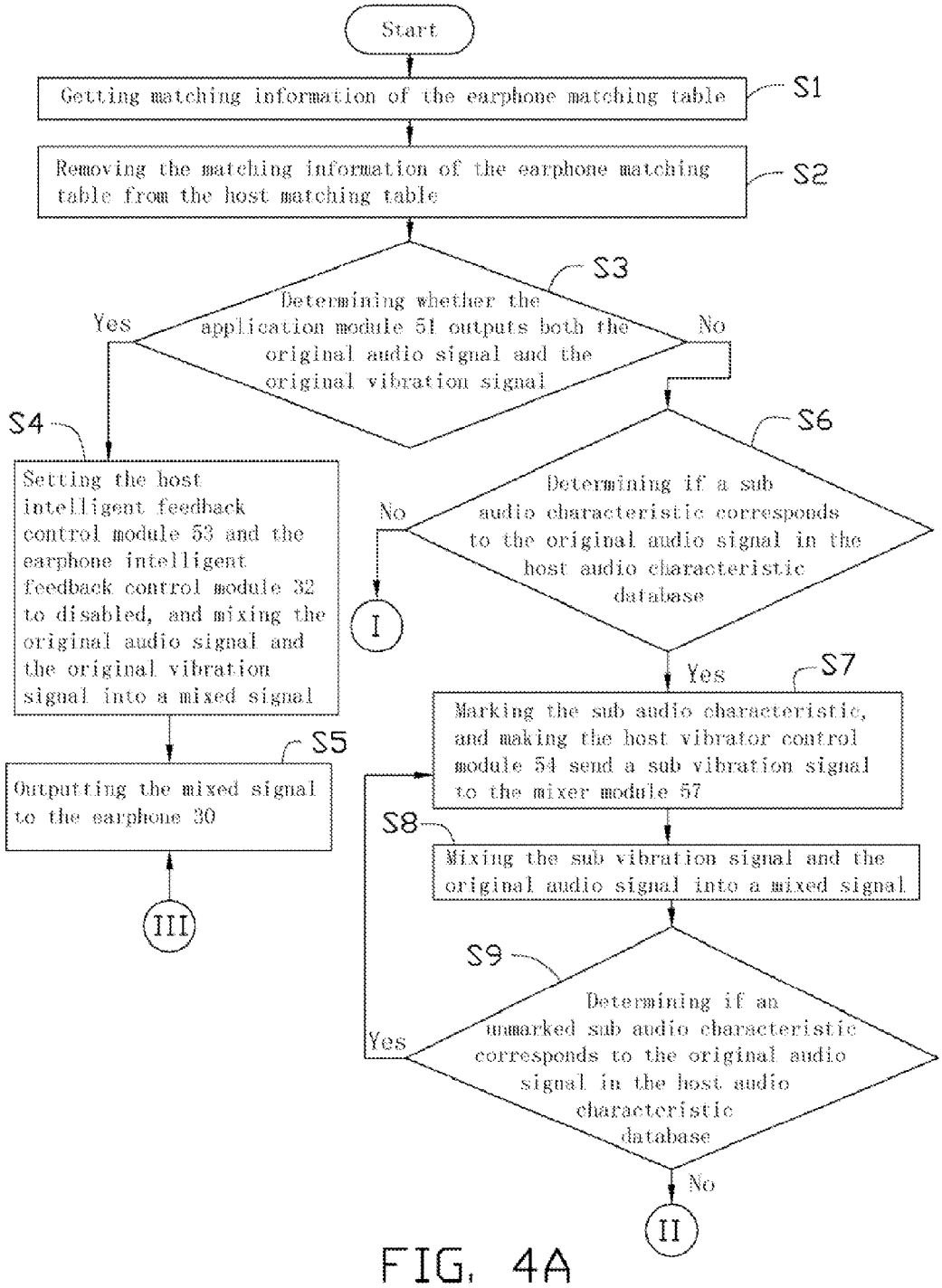
FIGS. 4A-4B are flowcharts illustrating a intelligent feedback process in the host, according to the embodiment.
Figure 4B:
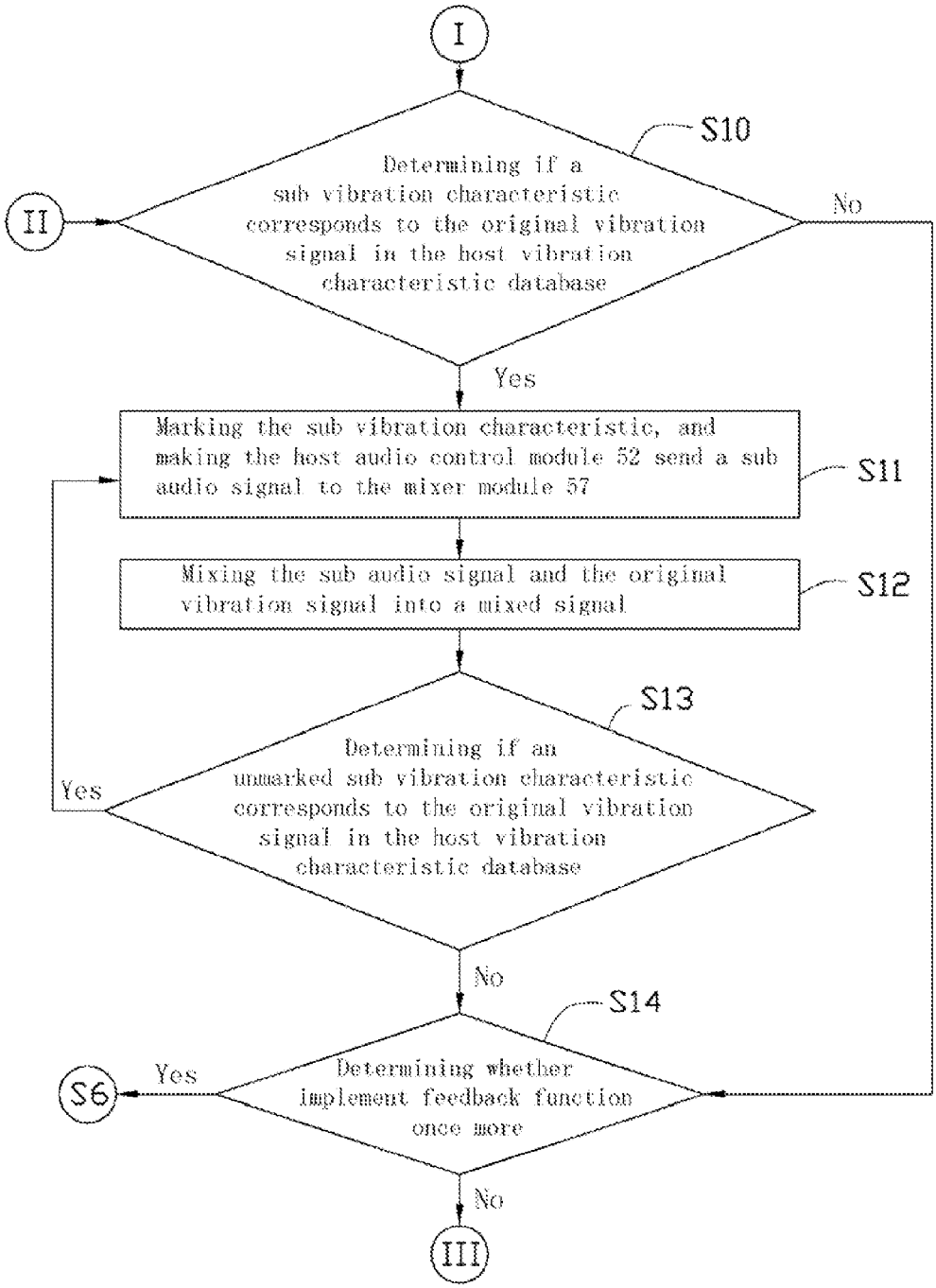

The electronic device 10 functions as follows:

The earphone 30 communicates with the host 50 via wired or wireless connections. Referring to FIG. 4A and FIG. 4B, the host 50 functions as follows:

In step S1, the host intelligent feedback control module 53 gets the matching information of the earphone matching table.

In step S2, the host intelligent feedback control module 53 removes the matching information of the earphone matching table from the host matching table.

In step S3, the host intelligent feedback control module 53 determines whether the application module 51 generates both the original audio signal and the original vibration signal. If the application module 51 generates both the original audio signal and the original vibration signal, step S4 is implemented. If the application module 51 does not generate both the original audio signal and the original vibration signal, step S6 is implemented.

In step S4, the host intelligent feedback control module 53 and the earphone intelligent feedback control module 32 are disabled. The mixer module 57 mixes the original audio signal and the original vibration signal into a mixed signal.

In step S5, the host interface module 58 outputs the mixed signal to the earphone 30.

In step S6, the host intelligent feedback control module 53 determines whether a sub audio characteristic corresponds to the original audio signal in the host audio characteristic database. If a sub audio characteristic corresponds to the original audio signal, step S7 is implemented. If no sub audio characteristic corresponds to the original audio signal, step S10 is implemented.

In step S7, the host intelligent feedback control module 53 marks the sub audio characteristic, and makes the host vibrator control module 54 send a sub vibration signal to the mixer module 57 according to the sub audio characteristic.

In step S8, the mixer module 57 mixes the sub vibration signal and the original audio signal into a mixed signal.

In step S9, the host intelligent feedback control module 53 determines whether an unmarked sub audio characteristic corresponds to the original audio signal in the host audio characteristic database. If an unmarked sub audio characteristic corresponds to the original audio signal, step S7 is implemented. If no unmarked sub audio characteristic corresponds to the original audio signal, step S10 is implemented.

In step S10, the host intelligent feedback control module 53 determines whether a sub vibration characteristic corresponds to the original vibration signal in the host vibration characteristic database. If a sub vibration characteristic corresponds to the original vibration signal, step S11 is implemented. If no sub vibration characteristic corresponds to the original vibration signal, step S14 is implemented.

In step S11, the host intelligent feedback control module 53 marks the sub vibration characteristic, and makes the host audio control module 52 send a sub audio signal to the mixer module 57 according to the sub vibration characteristic.

In step S12, the mixer module 57 mixes the sub audio signal and the original vibration signal into a mixed signal.

In step S13, the host intelligent feedback control module 53 determines whether an unmarked sub vibration characteristic corresponds to the original vibration signal in the host vibration characteristic database. If an unmarked sub vibration characteristic corresponds to the original vibration signal, step S11 is implemented. If no unmarked sub vibration characteristic corresponds to the original vibration signal, step S14 is implemented.

In step S14, the host intelligent feedback control module 53 determines whether implement feedback function once more, that is to implement the steps S6-S13. If the host intelligent feedback control module 53 needs to implement feedback function once more, step S6 is implemented. If the host intelligent feedback control module 53 does not need to implement feedback function once more, step S5 is implemented. The steps S6-S14 are a feedback process of the host intelligent feedback control module 53.

The feedback process of the earphone intelligent feedback control module 32 is similar to the feedback process of the host intelligent feedback control module 53 except that steps S8 and S12 are omitted.

The electronic device 10 generates audio signals according to vibration signals, and generates vibration signals according to audio signals. The vibrator vibrates corresponding to the sound of the speaker, so users can immerse with the sound and the scenes through the sound and the vibration synchronized with the sound.

In other embodiment, the matching information of the earphone matching table is not included among the matching information of the host matching table, the step S1-S2 in the above-described embodiment can be omitted.

It is to be further understood that even though numerous characteristics and advantages of the present embodiment have been set forth in the foregoing description, together with details of structures and functions of various embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An electronic device, comprising:

a host comprising a non-transitory host storage system and at least one host processor;

an earphone communicating with the host, the earphone comprising a non-transitory earphone storage system, at least one earphone processor, at least one earphone speaker, and at least one vibrator;

one or more programs that are stored in the non-transitory host storage system and are executed by the at least one host processor, the one or more programs stored in the non-transitory host storage system comprising instructions:

to generate a first vibration signal according to an original audio signal from a non-transitory application module of the host, and send the original audio signal and the first vibration signal to the earphone; or to generate a first audio signal according to a original vibration signal from the non-transitory application module of the host, and send the original vibration signal and the first audio signal to the earphone; and one or more programs that are stored in the non-transitory earphone storage system and are executed by the at least one earphone processor, the one or more programs stored in the non-transitory earphone storage system comprising instructions:

to generate a second vibration signal according to the original audio signal, send the first vibration signal and the second vibration signal to the at least one vibrator, and send the original audio signal to the at least one earphone speaker; or to generate a second audio signal according to the original vibration signal, send the first audio signal and the second audio signal to the at least one earphone, and send the original vibration signal to the at least one vibrator.

2. The electronic device as claimed in claim 1, wherein the one or more programs stored in the non-transitory earphone storage system further comprise instructions:

to make the at least one earphone speaker sound according to the original audio signal, and make the at least one vibrator vibrate according to the first vibration signal and the second vibration signal; or to make the at least one earphone speaker sound according to the first audio signal and the second audio signal, and make the at least one vibrator vibrate according to the original vibration signal.

3. The electronic device as claimed in claim 2, wherein the one or more programs stored in the non-transitory host storage system further comprise instructions:

to send the original audio signal and the original vibration signal to the earphone if the non-transitory application module generates both the original audio signal and the original vibration signal.

4. The electronic device as claimed in claim 3, wherein the one or more programs stored in the non-transitory earphone storage system further include instructions:

to make the at least one earphone speaker sound according to the original audio signal, and make the at least one vibrator vibrate according to the original vibration signal.

5. The electronic device as claimed in claim 4, wherein each earphone speaker corresponds to one vibrator.

6. A method of an electronic device, the electronic device comprising a host and an earphone communicating with the host, the host comprising an non-transitory application module, the earphone comprising at least one earphone speaker, and at least one vibrator; the method comprising:

determining whether the non-transitory application module generates both an original audio signal and an original vibration signal;

outputting the original audio signal and the original vibration signal to the earphone, making the earphone speaker sound according to the original audio signal, and making the vibrator vibrate according to the original vibration signal if the non-transitory application module generates both the original audio signal and the original vibration signal;

generating a first vibration signal according to the original audio signal, sending the original audio signal and the first vibration signal to the earphone, generating a second vibration signal according to the original audio signal, sending the first vibration signal and the second vibration signal to the at least one vibrator, and sending the original audio signal to the at least one earphone speaker if the non-transitory application module generates only the original audio signal;

generating a first audio signal according to the original vibration signal, sending the original vibration signal and the first audio signal to the earphone, generating a second audio signal according to the original vibration signal, sending the first audio signal and the second audio signal to the at least one earphone, and sending the original vibration signal to the at least one vibrator if the non-transitory application module generates only the original vibration signal.

7. The method as claimed in claim 6, further comprising making the at least one earphone speaker sound according to the original audio signal, and making the at least one vibrator vibrate according to the first vibration signal and the second vibration signal if the non-transitory application module generates only the original audio signal.

8. The method as claimed in claim 7, further comprising making the at least one earphone speaker sound according to the first audio signal and the second audio signal, and making the at least one vibrator vibrate according to the original vibration signal if the non-transitory application module generates only the original vibration signal.

9. The method as claimed in claim 8, wherein each earphone speaker corresponds to one vibrator.

10. A non-transitory computer readable storage medium storing instructions, that when executed by a processor, causes the processor to perform a method of an electronic device, the electronic device comprising a host and an earphone communicating with the host, the host comprising an non-transitory application module, the earphone comprising at least one earphone speaker, and at least one vibrator; the method comprising:

determining whether the non-transitory application module generates both an original audio signal and an original vibration signal;

outputting the original audio signal and the original vibration signal to the earphone, making the earphone speaker sound according to the original audio signal, and making the vibrator vibrate according to the original vibration signal if the non-transitory application module generates both the original audio signal and the original vibration signal;

generating a first vibration signal according to the original audio signal, sending the original audio signal and the first vibration signal to the earphone, generating a second vibration signal according to the original audio signal, sending the first vibration signal and the second vibration signal to the at least one vibrator, and sending the original audio signal to the at least one earphone speaker if the non-transitory application module generates only the original audio signal;

generating a first audio signal according to the original vibration signal, sending the original vibration signal and the first audio signal to the earphone, generating a second audio signal according to the original vibration signal, sending the first audio signal and the second audio signal to the at least one earphone, and sending the original vibration signal to the at least one vibrator if the non-transitory application module generates only the original vibration signal.

11. The non-transitory computer readable storage medium as claimed in claim 10, wherein the method further comprising:

making the at least one earphone speaker sound according to the original audio signal, and making the at least one vibrator vibrate according to the first vibration signal and the second vibration signal if the non-transitory application module generates only the original audio signal.

12. The non-transitory computer readable storage medium as claimed in claim 11, wherein the method further comprising:

making the at least one earphone speaker sound according to the first audio signal and the second audio signal, and making the at least one vibrator vibrate according to the original vibration signal if the non-transitory application module generates only the original vibration signal.

13. The non-transitory computer readable storage medium as claimed in claim 12, wherein each earphone speaker corresponds to one vibrator.

* * * * *